US005245707A

United States Patent [19]

Green

[11] Patent Number: 5,245,707

[45] Date of Patent: Sep. 21, 1993

[54] SUITE & BLOUSE SAVER DRESS SHIELD DEVICE

[76] Inventor: Janis Y. Green, 19309 Richwood Ct., Brookeville, Md. 20833

[21] Appl. No.: 860,883

[22] Filed: Mar. 31, 1992

[51] Int. Cl.[5] ..... A41D 27/13

[52] U.S. Cl. ..... 2/54; 2/55; 2/57; 450/86

[58] Field of Search ..... 2/2, 44, 46, 53, 54, 2/55, 56, 57, 58, 102, 105, 106; 450/64, 79, 80, 86

[56] References Cited

U.S. PATENT DOCUMENTS

| | | | |
|---|---|---|---|
| 567,285 | 9/1896 | Wormer | 2/55 |
| 847,241 | 3/1907 | Cochran | 2/55 |
| 920,325 | 5/1909 | Heber | 2/55 X |
| 944,090 | 12/1909 | Grund | 2/55 |
| 1,122,113 | 12/1914 | Hausner | 2/55 |
| 1,156,808 | 10/1915 | Perillat | 450/86 X |
| 1,177,060 | 3/1916 | Scovell | 2/55 |
| 1,363,727 | 12/1920 | Guinsburg . | |
| 1,416,044 | 5/1922 | Martin . | |
| 2,224,253 | 12/1940 | Clark | 2/56 |
| 2,406,699 | 8/1946 | Lustig | 450/64 |
| 2,475,893 | 7/1949 | Hayes | 450/64 |
| 2,573,346 | 10/1951 | Madsen | 2/55 |
| 2,636,175 | 8/1953 | Hoffman, Jr. . | |
| 2,687,527 | 8/1954 | Rendino . | |
| 2,725,563 | 12/1955 | Rich | 450/64 X |
| 2,808,589 | 10/1957 | Tyroler | 2/54 |
| 2,946,125 | 7/1960 | Gittelson | 450/64 X |
| 3,465,754 | 9/1969 | Lockwood et al. | 450/86 X |
| 4,894,868 | 1/1990 | Christopher | 450/86 X |
| 5,042,089 | 8/1991 | Carmer . | |

FOREIGN PATENT DOCUMENTS

| | | | |
|---|---|---|---|
| 0431069 | 7/1926 | Fed. Rep. of Germany | 450/64 |
| 098449 | 10/1940 | Fed. Rep. of Germany | 2/55 |

*Primary Examiner*—Clifford D. Crowder
*Assistant Examiner*—Jeanette E. Chapman

[57] ABSTRACT

A dress shield device comprising the combination of a vest type holder and a pair of removable dress shields. The vest holder comprises an over-the-shoulder strap and an adjustable chest strap leading around the torso of the wearer. The shoulder straps are stitched at the lower edge, providing a loop for each armhole of the vest holder. The shoulder straps are secured to the adjustable chest strap. The dress shields are attached by hook and loop strips sometimes known as VELCRO TM to the area of the vest holder worn next to the underarm area of the wearer.

4 Claims, 1 Drawing Sheet

SUITE & BLOUSE SAVER DRESS SHIELD DEVICE

FIELD OF THE INVENTION

The present invention relates to garment accessories, which are often called "dress shields" helping women solve the underarm perspiration problem.

More particularly, the invention relates to an apparatus providing a vest type holder with removable dress shields.

BRIEF SUMMARY OF THE INVENTION

The object of this invention is to provide a vest type holder which supports an easily removable pair of dress shields held in place at the underarm area. The vest can be worn several times without laundering while the dress shields can be removed and conveniently laundered after every wearing. The shields absorb perspiration and protect garments from deodorant discoloration.

The advantages of the new dress shield device verses the old are that a dress shield can be held in place without the use of pins or handsewing for each individual garment. This invention is more attractive, functional, and comfortable because the shield holder (vest device) moves and stretches with each body movement. The next device can be manufactured of stretch lace (spandex or nylon elastic two to three inches in width) to be more attractive and comfortable to the wearer. This material is also soft, comfortable, light, and cool. The stretch lace material is strong but must not be laundered in hot water. This device does not have to be laundered after each wearing as the old single unit type because perspiration is absorbed on the separate removable shield units. The removable shields are manufactured to withstand hot water laundering and strong detergents and are made to cover only the underarm area. These shields are of a cotton polyester blend fabric so they can be laundered by hand quickly in hot soapy water and air dried over night for the next day. The old one unit garment shield device, takes up more space to launder, they don't dry as quickly, and must be laundered as a whole unit. The former dress shields have two parts, upper and lower but with the new design there is only one part. It is now possible to wear the shields of the present disclosure with short sleeved garments. The old dress shield has waterproofing which may cause the wearer to perspire while the new one has moisture absorbing material. The new shields may manufactured as a one size fits all. This invention reduces: the time required to launder fine clothes, dry cleaning bills, and garment deterioration.

Description of drawings

Enlarged inside view of device removed from body with the shields removed and with the sides shown which is worn against the body

DETAILED DESCRIPTION OF ILLUSTRATIVE

Figure 1:
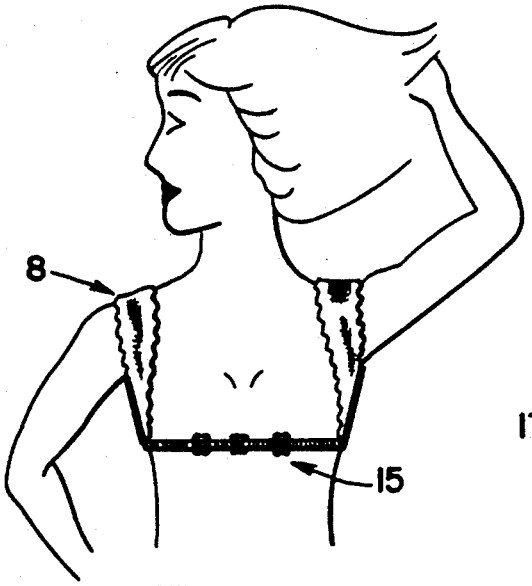
FIG. 1—
Front elevation view of a women showing the dress shield garment in applied positions
Figure 4:
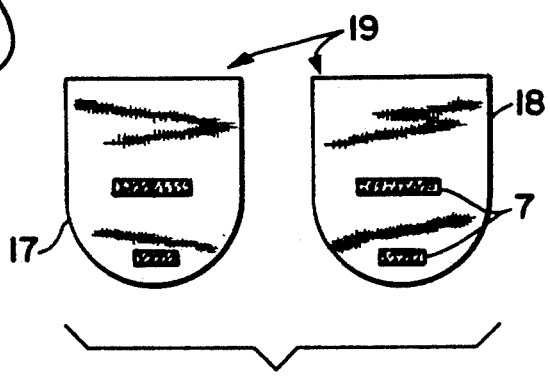
FIG. 4—
Enlarged view of pair of shields
Figure 2:
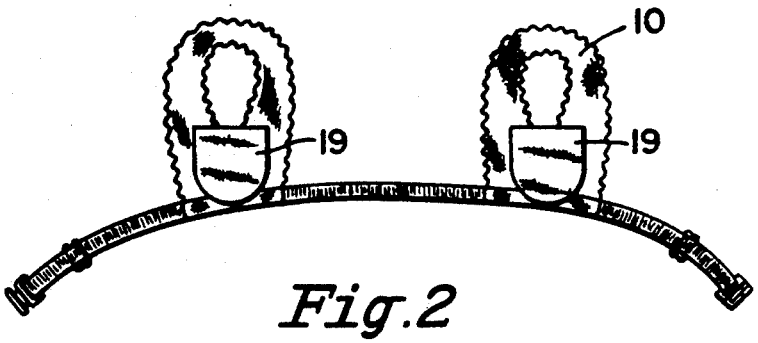
FIG. 2—
Enlarged inside view of device removed from body with the shields attached and with the sides shown which is worn against the body
Figure 5:
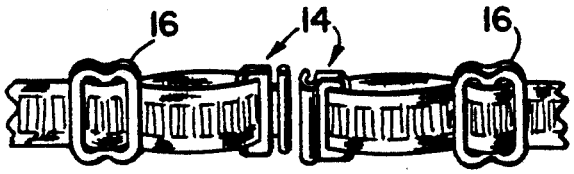
FIG. 5—
Enlarged view of the front clasps and the slide adjusters
Figure 3:
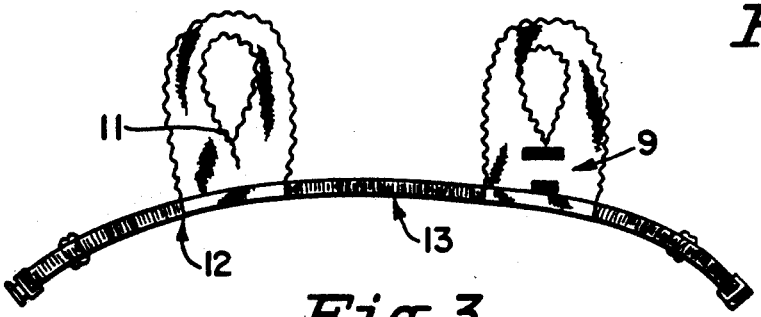
FIG. 3—

The invention has two distinct and separate units: the vest device and a pair of dress shields. The invention provides a mini vest 10 of stretch lace between 2–3" in width, somewhat elastic in nature with the ability to be soft and stretch. There are two straps of lace to form two armholes. Each lace strap is sewn together at a junction 11 joining a pair of lower elongated edges of the lace, this creates a loop for each armhole of the vest. The connected edges of the lace 11 provides a 4–6" in width area for supporting the dress shields. The loops are sewn to an elastic strip 13 in the area of their junction and spaced so that each loop may engage each armhole at the same time. The said strip extends around the torso of the wearer. At the end of the elastic strip a female front closure clasp is sewn and at the other end the male front closure clasp is sewn, thus creating a front closure 14. This elastic is worn around the trunk of the body 15. On each side of the clasps are slide adjusters 16 to adjust the strip 13 to a wearer's individual size. The invention provides a pair of dress shields 19 held close to the underarm area of the wearer by employing the mini vest described above. One side of the shield 19 has two small strips of hook and loop material (sometimes known as VELCRO TM ). The hook side 7 is sewn on the shield for attachment to the inside or support area of the lace straps of the vest device which has the loop strips 9 sewn on the vest. Two strips on a single shield hold the shield more securely in place. The shields are manufactured in the shape of a semi circle at the lower end 17 and straight across at the top 18. This will prevent the shields from flopping down or being exposed in a short sleeved garment.

What is claimed is

1. A dress shield device comprising:

a pair of dress shields and a pair of shoulder straps; said shoulder straps pass over the shoulder of a wearer with the edges of each strap stitched together to create an enclosed loop for an armhole, and the stitched together edges also define a junction point; each armhole loop is sewn to an adjustable elastic strip; said strip extends around the torso of the wearer; a female front closure clasp is sewn at one end of said strip and a male front closure clasp is sewn at the other end of said strip; said junction of the stitched together edges provides an area to support each dress shield; two small strips of hook and loop tape are sewn to said area of each lace strap to mate with another pair of hook and loop tapes sewn to each pair of dress shields.

2. The dress shield device is described in claim 1, said shoulder straps comprise a stretch lace material, elastic in nature.

3. The dress shield device as described in claim 1, said elastic strip includes slide adjustors for adjusting the length of the elastic strip around said wearer's torso.

4. A dress shield device as described in claim 1, a bottom edge of each dress shield is rounded and a top edge is straight.

* * * * *